US006658835B1

(12) United States Patent
Bowers

(10) Patent No.: US 6,658,835 B1
(45) Date of Patent: Dec. 9, 2003

(54) UNTWISTED WRAPPED SINGLES YARNS AND CARPETS MANUFACTURED THEREFROM

(75) Inventor: Charles Edward Bowers, Hopewell, VA (US)

(73) Assignee: Honeywell International Inc., Morristown, NJ (US)

( * ) Notice: Subject to any disclaimer, the term of this patent is extended or adjusted under 35 U.S.C. 154(b) by 336 days.

(21) Appl. No.: 09/723,643

(22) Filed: Nov. 28, 2000

(51) Int. Cl.[7] ..... D02G 3/02

(52) U.S. Cl. ..... 57/210; 57/224; 57/228; 57/255

(58) Field of Search ..... 57/210, 224–228, 57/238, 239, 243–247, 252, 254

(56) References Cited

U.S. PATENT DOCUMENTS

| | | | | |
|---|---|---|---|---|
| 2,252,999 A | | 8/1941 | Wallach | 57/140 |
| 2,880,112 A | | 3/1959 | Drelich | 117/37 |
| 3,494,819 A | | 2/1970 | McAlister | 161/89 |
| 3,494,822 A | | 2/1970 | Weldon | 161/172 |
| 3,828,542 A | | 8/1974 | Boutonnet et al. | 57/140 |
| 3,877,214 A | | 4/1975 | Van der Werf | 57/164 |
| 3,978,267 A | | 8/1976 | Selwood | 428/360 |
| 3,978,647 A | | 9/1976 | Kosaka et al. | 57/140 |
| 4,307,566 A | | 12/1981 | Murata et al. | 57/228 |
| 4,355,592 A | | 10/1982 | Tajiri et al. | 112/410 |
| 4,424,250 A | | 1/1984 | Adams | 428/198 |
| 4,495,758 A | | 1/1985 | Stahlecker | 57/19 |
| 4,552,603 A | | 11/1985 | Harris, Jr. et al. | 156/167 |
| 4,601,949 A | | 7/1986 | Bach et al. | 428/374 |
| 4,644,741 A | | 2/1987 | Gradinger et al. | 57/256 |
| 4,668,552 A | | 5/1987 | Scott et al. | 428/92 |
| 4,668,553 A | | 5/1987 | Scott et al. | 428/92 |
| 4,802,330 A | * | 2/1989 | Yngve et al. | 57/238 |
| 4,871,604 A | | 10/1989 | Hackler | 428/96 |
| 5,010,723 A | | 4/1991 | Wilen | 57/210 |
| 5,102,713 A | | 4/1992 | Corbin et al. | 428/92 |
| 5,141,780 A | | 8/1992 | Hackler et al. | 427/389.9 |
| 5,478,624 A | | 12/1995 | Lofquist | 428/97 |
| 5,567,256 A | | 10/1996 | Queen et al. | 156/72 |
| 5,910,361 A | | 6/1999 | Guevel et al. | 428/364 |
| 6,132,868 A | | 10/2000 | Dean et al. | 428/364 |
| 6,218,009 B1 | * | 4/2001 | Tsai et al. | 428/373 |

FOREIGN PATENT DOCUMENTS

| | | | |
|---|---|---|---|
| EP | 0 324 773 | 11/1990 | D02G/3/40 |
| EP | 0 444 637 | 9/1991 | D02G/3/40 |
| EP | 0 466 618 | 1/1992 | D02G/3/38 |
| EP | 0 696 655 | 2/1996 | D01F/8/06 |
| FR | 2124919 | 9/1972 | D02G/3/00 |
| GB | 1168404 | 10/1969 | C08G/20/02 |
| GB | 1208293 | 10/1970 | D02J/1/00 |
| GB | 2205116 | 5/1988 | D05C/17/02 |
| JP | 52-18835 | 5/1977 | D03D/27/00 |
| JP | 60-224831 | 11/1985 | D02G/3/44 |
| JP | 61-100222 | 5/1986 | A47L/13/20 |
| JP | 61-100223 | 5/1986 | A47L/13/20 |
| JP | 61-245322 | 10/1986 | D02G/1/02 |
| JP | 09119034 | 5/1997 | |
| WO | WO 88/03969 | 6/1988 | D02G/3/40 |
| WO | WO 94/09196 | 4/1994 | D02G/3/40 |
| WO | WO 94/20657 | 9/1994 | D02G/3/40 |
| WO | WO 96 37644 A | 11/1996 | |
| ZA | 98/8628 * | 9/1999 | |

* cited by examiner

*Primary Examiner*—John J. Calvert
*Assistant Examiner*—Shaun R Hurley
(74) *Attorney, Agent, or Firm*—Virginia Szigeti

(57) ABSTRACT

The yarns of the invention include untwisted wrapped singles yarns having a core strand and a wrapper yarn. The wrapper yarn is a base synthetic fiber and a heat-activated binder fiber with a melting point substantially below that of the base synthetic fiber. The Saxony carpets of the invention are made from untwisted singles yarn tufts and are possessed of surface appearance, individual tip retention, pile density, resilient hand and wear resistance comparable or superior to conventional Saxony carpets made from multiple plied twist set yarns.

26 Claims, No Drawings

UNTWISTED WRAPPED SINGLES YARNS AND CARPETS MANUFACTURED THEREFROM

This application is related to application Ser. No. 08/933, 822 filed Sep. 19, 1997.

BACKGROUND OF THE INVENTION

1. Field of the Invention

This invention relates to novel yarns for the manufacture of Saxony carpets, upholstery and other applications, carpets manufactured therefrom and the method of their manufacture. The yarns of the invention comprise untwisted wrapped singles yarns having a core strand and a wrapper yarn. The wrapper yarn is comprised of a base synthetic fiber and a heat-activated binder fiber with a melting point substantially below that of the base synthetic fiber. The Saxony carpets of the invention are comprised of untwisted singles yarn tufts and are possessed of surface appearance, individual tip retention, pile density, resilient hand and wear resistance comparable or superior to conventional Saxony carpets made from multiple plied twist set yarns.

2. Description of the Related Art

A large portion of carpets used in residences in the United States are known as cut pile carpets. In their manufacture, pile yarn is inserted into a backing material as loops. The loops are cut to form vertical tufts and then usually sheared to an even length. There are two principal types of cut pile carpets: plush and Saxony. In plush carpets, the fibers from one tuft are indistinguishable from the fibers from surrounding tufts, giving a velvet-like appearance. In Saxony carpets, the individual pile yarn tufts are well defined giving a pointilist effect.

Cut-pile carpet is customarily produced from staple yarns or bulked continuous filament yarn. Staple fiber may be processed into yarn suitable for cut pile carpets by techniques known in the art. Generally, such techniques involve first combing crimped staple fiber in a carding machine to form a sliver which is a continuous strand of loosely assembled fibers without twist. The sliver is then drafted on a drafting machine to improve its thickness uniformity and subsequently spun and twisted on a spinning machine to form singles twisted yarn.

To produce plush carpets, the singles twisted yarn may be tufted directly into the backing material. However, to produce Saxony carpets, the torque in the singles twisted yarn must be neutralized. This is done by plying with other singles twisted yarn(s) to form a 2-ply or 3-ply yarn construction and twisting the plied yarns in the opposite sense from the twist in the singles yarn. The twisted yarn is then subjected to a heat-setting operation where the twist is heat-set utilizing one of several commercially available twist setting processes such as the Suessen or Superba processes, thus making the yarn suitable for tufting.

In a typical twist setting process, the yarn is passed through a heated chamber, while in a relaxed condition. The temperature of this process step is crucial to the proper twist setting of the base fiber to obtain desired properties of the final carpet product. For nylon-6 base fiber, the conditions for this step are typically 190–200° C. with a residence time of about 60 seconds for the Suessen process and about 130–140° C. with a residence time of about 60 seconds for the Superba process.

Similarly, bulked (texturized or crimped) continuous filament nylon yarn is produced according to various conventional methods. Twisting, entangling, or direct cabling may be utilized in various processes. For example, a 2-ply twisted yarn combining 2 ends of 1185 denier 70 filament yarn is prepared and subjected to conventional twist setting conditions, such as that for the staple yarn above or in an autoclave at 132° C. in saturated steam with a residence time of about 60 minutes. Multiple ends of the twist set yarns are tufted into cut pile carpet and conventionally finished to obtain the desired Saxony carpet product.

The perceived value of Saxony carpets is dependent upon several factors including carpet bulk and carpet "texture retention." By the term, "texture retention" as used herein, it is meant the ability of the carpet to retain its original tuft definition after being subjected to traffic. When Saxony carpets are new, they have a pleasing texture. The bulked yarns, which form the tufts, provide firmness and body to the carpet. The ply-twist in the individual tufts allows for good tuft definition, which gives the carpet a uniform and sharp appearance. Each tuft appears distinctly separate from neighboring tufts. However, when the carpet is subjected to a high degree of traffic, the tufts begin to untwist. This loss of twist causes the tuft tips to splay open. The individual filaments of one tuft tend to mingle with filaments of adjacent tufts giving the carpet a matted appearance and loss of texture. A need exists for yarns that improve texture retention in carpets.

It is known that carpet bulk can be improved by increasing the face weight of the carpet or by increasing the crimp imposed on the face fiber. However, carpet face weight is directly proportional to the carpet's total production cost. Furthermore, highly crimped staple fiber can create processing problems, specially during the carding operation. A need exists for Saxony carpet yarns that may be tufted into carpets to provide good carpet bulk in such a manner that the above problems are avoided.

It is known that conventional Saxony carpet yarns require two or three plies of twisted singles yarns re-twisted together in order to yield carpets having satisfactory bulk and texture retention. Thus far, it has not been possible to produce satisfactory Saxony carpets from singles yarns. However, the process of twisting, plying and re-twisting several singles yarns together is slow and costly. A need exists for a singles yarn construction, that when used without further plying, will yield Saxony carpet quality at least equal to that obtained from multiple plied twist set yarns, and which can be made by a simpler, more economic process.

There is a long history of prior art processes that have had the objectives of improving the properties of yarns for various purposes through use of a low melting binder material incorporated in the yarn. These include U.S. Pat. Nos. 2,880,112; 3,494,819; 3,494,822; 3,828,542; 3,877,214; 4,552,6034; 4,644,741; 5,910,361; European Patent Nos. 444,637; 696,655; British Patent No. 2,205,116; South African Patent No. 72,0545 (equivalent to French Patent No. 72,02930); and Japanese Patents and Publications Nos. 61-10023; 61-100222; 61-245322. More pertinent to the current invention are U.S. Pat. Nos. 2,252,999; 3,494,822; 4,668,552; 4,668,553; 4,871,604; 5,010,723; 5,141,780; 5,478,624; 5,567,256; PCT Publication Nos. WO 88/03969; WO 94/09196; WO 94/20657; European Patent 324,773, and Japanese Patents and Publications Nos. 52-18835; 60-224,831. Most pertinent, the current invention is an improvement of the co-pending application, Ser. No. 08/933, 822 filed Sep. 19, 1997, and South African Patent 98/8628.

U.S. Pat No. 5,478,624 and European Patent 324,773 describe carpet yarns comprising a blend of at least one base fiber selected from the group consisting of polyester, nylon 6 and nylon 66, and 1–12 weight percent of a heat activated binder fiber. The disclosure of U.S. Pat. No. 5,478,624 is hereby specifically incorporated by reference to the extent not inconsistent herewith. U.S. Pat. No. 4,668,552 describes a wrapped yarn for upholstery fabrics comprising a body strand of untwisted staple fibers and a binder strand formed of about 3 to 10 wt. % of a thermoplastic polymer having heat shrinkable and fusible properties. Japanese Kokai 60-224,831 describes single ply twisted carpet face yarns for plush carpets. Co-pending application, Ser. No. 08/933,822 filed Sep. 19, 1997 and South African Patent 98/8628 broadly describe wrapped yarns comprising a binder material in the wrapper yarns.

Each of the yarn constructions in the patents and publications cited above represented improvements in the state of their respective arts. However, none described the specific constructions of the yarns of this invention and none satisfied all of the needs met by this invention.

SUMMARY OF THE INVENTION

This invention relates to novel yarns for the manufacture of Saxony carpets, upholstery and other applications, carpets manufactured therefrom and the method of their manufacture. More specifically, the invention provides an untwisted singles yarn construction from which carpets can be produced having properties equal to or superior to carpets made from multiple plied twisted yarns. Further, the carpets of the invention are produced by a simpler and more economic process. These have been long felt but unmet needs.

The yarns of the invention are untwisted wrapped yarns comprising a core strand and a wrapper yarn. The core strand comprises a member selected from the group consisting of a sliver and a bulked continuous filament yarn. The core strand is comprised of at least one member selected from the group consisting of textile fibers of cotton, wool, polyester, polyolefin, and polyarnide.

The wrapper yarn comprises a member selected from the group consisting of a spun staple yarn and a continuous filament yarn. In one embodiment, the wrapper yarn is comprised of at least one base synthetic fiber material selected from the group consisting of polyester, polyolefin, polyarnide, and a heat activated binder fiber having a melting point at least 20° C. lower than the base synthetic fiber.

In another embodiment, the wrapper yarn is comprised of continuous filament composite fibers. The composite fibers are comprised of a base synthetic fiber material selected from the group consisting of polyester, polyolefin, polyarnide, and a heat activated binder material having a melting point at least 20° C. lower than the base synthetic fiber material.

The invention also includes Saxony carpets produced from an untwisted wrapped singles yarn wherein said yarn comprises a core strand and a wrapper yarn, and wherein the wrapper yarn is comprised of a base synthetic fiber material and a heat activated binder material having a melting point at least 20° C. lower than the base synthetic fiber material.

The invention further includes the method of making a Saxony carpet comprising the steps: forming an untwisted core strand comprising at least one member selected from the group consisting of a natural or synthetic fiber; forming a wrapper yarn comprising at least one base synthetic fiber material, and a heat activated binder fiber having a melting point at least 20° C. lower than the base synthetic fiber; wrapping the wrapper yarn about the core strand; heat setting the wrapped singles yarn at a temperature sufficient to melt the heat activated binder material, then subsequently cooling and solidifying said melt, thereby constricting the base synthetic fiber component of the wrapper yarn about the core strand and securing it to the core strand; incorporating the heat-treated yarn into a backing material as loops; cutting the loops to form vertical tufts; and dying and finishing.

DETAILED DESCRIPTION OF THE INVENTION

The present invention provides novel untwisted wrapped yarns for Saxony carpets, upholstery and other applications, carpets manufactured therefrom and the method of their manufacture. The yarns of the invention comprise untwisted wrapped singles yarns having a core strand and a wrapper yarn. The core strand is comprised of untwisted bulked continuous filament yarn or a sliver of a natural or synthetic fiber. The wrapper yarn is comprised of a base synthetic fiber and a heat-activated binder fiber with a melting point substantially below that of the base synthetic fiber.

The yarn of the invention provides an answer to long-standing needs. It provides improved texture retention, tip definition, bulk and wear resistance, thus providing added value to consumers. It is an untwisted singles yarn and therefore eliminates the slow and expensive steps of twisting of the singles yarn, plying and re-twisting, previously necessary for applications such as Saxony carpets. It is expected to have numerous other applications such as in upholstery fabrics and automotive carpeting.

The yarns of the invention accomplish these results through the use of novel, specific constructions within narrow ranges. The prior art includes many examples of yarn constructions where a heat activated binder material is incorporated in twisted yarn. Also, the co-pending application, Ser. No. 08/933,822 filed Sep. 19,1997, and South African Patent 98/8628 describe a generic wrapped yarn where a heat activated binder material is incorporated in the wrapper yarn. However, there is no prior disclosure or suggestion of an untwisted wrapped singles yarn comprising a base synthetic fiber wrapper yarn containing heat activated binder material. The inclusion of each of these characteristics is essential to the success of the yarns of the invention. Further, there is no prior disclosure or suggestion that Saxony carpets could be made from such an untwisted yarn having tuft definition, tip retention, hand and wear resistance equivalent to or better than carpets of equal pile weight made from multiple plied twist set yarns, and more simply and at lower cost.

Without being held to a particular theory of why the invention works, it is believed that when the yarns of the invention are subjected to a heat setting operation at a temperature sufficient to melt the heat activated binder fiber in the wrapper yarn, elastic forces stored within the binder fiber are released, pulling and constricting the base synthetic fiber tight about the core strand. When the yarn is cooled, the base synthetic fiber constituent of the wrapper yarn presses on the core strand and is securely attached to the core strand. This radial constraint on the core strand provides the finished singles heatset yarn with a more resilient (stiffer) hand, a tighter more defined yarn structure and significantly greater yarn structure retention compared to a conventional wrapped singles heatset yarn. The untwisted nature of the yarn means there will be no spreading of the filaments due to relaxation of residual torque. The presence of a minor percent of heat activated binder fiber within the core strand is also beneficial.

The core strand of a yarn of the invention is comprised of an untwisted bulked continuous filament yarn or a sliver of a natural or a synthetic origin. A continuous filament yarn may be bulked by any of the well known methods for texturizing or crimping as false twist, stuffer box, edge crimp, gear crimp and others.

In one embodiment the core strand is a sliver of about 0.8 to 6 cotton count. (Cotton count is a term of art defined as the number of skeins of 840 yard length to weigh to one pound total.) Preferably the core strand is a sliver of about 1 to 5 cotton count. More preferably, the core strand is a sliver of about 1 to 3 cotton count.

In another embodiment, the core strand is a bulked continuous filament yarn of about 900 to 6000 denier. Preferably, the core strand is a bulked continuous filament yarn of about 1000 to 5300 denier. More preferably, the core strand is a bulked continuous filament yarn of about 1000 to 3000 denier.

The core strand is comprised of at least one textile fiber member selected from the group consisting of cotton, wool, polyester (preferably polyethylene terepthalate, polytrimethylene terepthalate), polyolefin (preferably polypropylene), and polyarnide (preferably nylon 6, nylon 66). The cotton count or denier of the core strand and the materials of which it is comprised are selected within these ranges to accommodate the requirements of the carpet or upholstery manufacturer.

References throughout this specification and claims to polyester, polyolefin and/or polyarnide, are deemed to also include copolymers thereof.

The core strand contains 0 to 12 wt % of a heat activated binder fiber having a melting point at least about 20° C. lower than the textile fiber constituents. Preferably, the core strand contains about 0 to 6 weight percent of a heat activated binder fiber having a melting point at least about 20° C. lower than the textile fiber constituents. More preferably, the core strand contains about 0 to 3 weight percent of a heat activated binder fiber having a melting point at least about 20° C. lower than the textile fiber constituents. Most preferably, the core strand contains about 0 to 1 weight percent of a heat activated binder fiber having a melting point at least about 20° C. lower than the textile fiber constituents.

Where the core strand is a sliver, the heat activated binder fiber is also a staple fiber and is preferably blended with the other constituents of the core strand prior to or during the carding operation. Where the core strand is a bulked continuous filament yarn, the heat activated binder fiber is a continuous filament fiber and may be parallel wound with the bulked continuous filament yarn. Preferably, the heat activated binder fiber is incorporated with the other constituent yarns by co-mingling or air entanglement prior to the bulking operation.

The wrapper yarn comprises a member selected from the group consisting of a spun staple yarn and a continuous filament yarn. Preferably, the wrapper yarn is a continuous filament yarn of about 20 to 200 denier. More preferably the wrapper yarn is a continuous filament yarn of about 40 to 80 denier.

The wrapper yarn makes about 2.0 to 10 wraps/inch about the core strand. Preferably, the wrapper yarn makes about 3 to 5 wraps/inch about the core strand.

In one embodiment, the wrapper yarn is comprised of at least one base synthetic fiber material selected from the group consisting of polyester (preferably polyethylene terepthalate, polytrimethylene terepthalate), polyolefin (preferably polypropylene), polyarnide (preferably nylon 6, nylon 66), and a heat activated binder fiber having a melting point at least 20° C. lower than the base synthetic fiber.

It is preferred that the material of the wrapper yarn is of the same chemical class as the material constituting a plurality of the core strand. For example, where the core strand is comprised of a plurality of polyarnide, the preferred wrapper yarn is a polyarnide. However, where the core strand is blend of cotton or wool with a minor amount of synthetic fiber, the preferred wrapper material is of the same chemical class as the synthetic fiber constituent. Where the core strand is wool unblended with a synthetic constituent, the preferred wrapper material is a polyarnide. Where the core strand is cotton unblended with a synthetic constituent, the preferred wrapper material is at least one member selected from the class consisting of a polyester and a polyarnide.

The wrapper yarn is comprised of about 5 to 95 weight percent of the heat activated binder fiber. Preferably, the wrapper yarn is about 15 to 85 weight percent heat activated binder fiber. More preferably, the wrapper yarn is about 25 to 75 weight percent heat activated binder fiber. It is critical to accomplishing the objectives of the invention that the wrapper yarn is comprised of both the base synthetic fiber and the heat activated binder fiber as these components act in synergy.

Preferably, the total content of heat activated binder fiber in a yarn of the invention, including the binder fiber content of both the core strand and the wrapper yarn is about 0.05–2.5 weight percent of the yarn.

The material of the heat activated binder fiber in the wrapper yarn is a member selected from the group consisting of polyarnides, polyesters and polyolefins. It is preferred that the material of the heat activated binder fiber is of the same chemical class as the base synthetic fiber of the wrapper yarn. For example, where the base synthetic fiber is a polyarnide, the preferred heat activated binder fiber is a polyarnide. Polyarnides, polyesters and polyolefins having the requisite melting points to serve as heat activated binder fibers are well known to those skilled in the art. For example, U.S. Pat. No. 5,478,624, heretofore incorporated by reference describes copolyarnides having the requisite melting points. U.S. Pat. No. 6,132,868 describes copolyesters suitable for binder fibers and is hereby specifically incorporated by reference to the extent not inconsistent herewith. Polyethylene fibers are suitable binder fibers for polypropylene wrapper yarns. Suitable binder fibers of various compositions are available commercially under the trade name GRILON® from EMS-Chemie AG Corp.

In an embodiment wherein the wrapper yarn is a spun staple yarn, the heat activated binder fiber is also a staple fiber and is preferably blended with the other constituents of the wrapper yarn prior to or during the carding operation. Where the wrapper is a continuous filament yarn, the heat activated binder fiber is preferably incorporated with the other constituent yarns by commingling or air entanglement.

In another embodiment, the wrapper yarn is comprised of continuous filament composite fibers. The composite fibers are comprised of a base synthetic fiber material selected from the group consisting of polyester (preferably polyethylene terepthalate, polytrimethylene terepthalate), polyolefin (preferably polypropylene), polyarnide (preferably nylon 6, nylon 66), and a heat activated binder material having a melting point at least 20° C. lower than the base synthetic fiber material. The base synthetic fiber material and the heat activated binder material are preferably of the same chemical class as the material comprising the plurality of the core strand. Where the core strand is blend of cotton or wool with a minor amount of synthetic fiber, the preferred wrapper material is of the same chemical class as the synthetic fiber constituent. Where the core strand is wool unblended with a synthetic constituent, the preferred wrapper material is a polyarnide. Where the core strand is cotton unblended with a synthetic material, the preferred wrapper material is at least one member selected from the class consisting of a polyester and a polyarnide.

In one embodiment, the composite fibers of the wrapper yarn have a sheath-core structure with the heat activated binder material comprising the sheath. In another embodiment, the base synthetic fiber material and the heat activated binder material have a side-by-side relationship in the composite fibers of the wrapper yarn. The composite fibers of the wrapper yarn may be made by any of the well known methods for spinning sheath-core or side-by-side (bi-component) fibers such as described in U.S. Pat. No. 4,552,603.

The composite fibers of the wrapper yarn are comprised of about 5 to 95 weight percent of the heat activated binder material. Preferably, the wrapper yarn is about 15 to 85 weight percent heat activated binder material. More preferably, the wrapper yarn is about 25 to 75 weight percent heat activated binder material.

Preferably, the total content of heat activated binder material of a yarn of the invention, including the binder material content of both the core strand and the composite fiber wrapper yarn is about 0.05–2.5 weight percent of the total yarn.

Preferably, the wrapper yarn is wrapped on the core strand by the hollow spindle method described in U.S. Pat. No. 4,495,758. A hollow spindle wrapping machine is manufactured commercially by Spindelfabrik Suessen Gmbh under the trademarke PARAFIL®.

The invention further includes the method of making a Saxony carpet comprising the steps: forming an untwisted core strand comprising at least one member selected from the group consisting of a natural or synthetic fiber; forming an untwisted wrapper yarn comprising at least one base synthetic fiber material, and a heat activated binder fiber having a melting point at least 20° C. lower than the base synthetic fiber; wrapping the wrapper yarn about the core strand; and heat setting the wrapped singles yarn at a temperature sufficient to melt the heat activated binder material, then subsequently cooling and solidifying said melt, thereby constricting the base synthetic fiber component of the wrapper yarn about the core strand and securing it to the core strand; incorporating the heat-treated yarn into a backing material as loops; cutting the loops to form vertical tufts; and dying and finishing.

The following examples are presented to provide a more complete understanding of the invention. The specific techniques, conditions, materials proportions and reported data set forth to illustrate the principles of the invention are exemplary and should not be construed as limiting the scope of the invention.

EXAMPLES

Yarn Preparation

In the following Examples and Comparative Examples, where wrapped yarns are prepared, they are prepared on a hollow spindle wrapping machine manufactured commercially by Spindelfabrik Suessen Gmbh. under the trademark PARAFIL®.

Comparative Example 1

A spun staple yarn comprising 17 dpf, 20 cm (8.0 inches) long, Honeywell International grade T317 nylon-6 staple fibers (melt point range of 215 to 225° C.) is ring spun into a 3.0/1 cotton count yarn containing 4.8 "Z" twists per inch (tpi). This singles yarn is then plied with another identical ring spun singles yarn and retwisted to produce 3.0/2 cotton count 4.8 "Z" tpi×4.1 "S" tpi yarn containing no binder material. This yarn is a 2 ply construction conventionally used in cut ply carpets and is the control material for the carpet evaluations which follow.

Comparative Example 2

A spun staple yarn comprising 17 dpf, 20 cm (8.0 inches) long, Honeywell International grade T317 nylon-6 staple fibers (melt point range of 215 to 225° C.), is wrapped with a 40 denier, 12 filament, continuous filament yarn of nylon-6 having a melt point range of 215 to 225° C. to produce a wrapped 3.0/1 cotton count yarn with 4.8 "Z" wraps per inch (wpi). This singles yarn is then plied with another identical wrap spun singles yarn and twisted to produce a 3.0/2 cotton count 4.8 "Z" wraps/inch×4.1 twists/inch (tpi) yarn containing no binder material.

Comparative Example 3

A spun staple yarn comprising 17 dpf, 20 cm (8.0 inches) long, Honeywell International grade T317 nylon-6 staple fibers (melt point range of 215 to 225° C.), is wrapped with a 40 denier, 12 filament, continuous filament yarn of nylon-6 having a melt point range of 215 to 225° C. to produce a wrapped 1.50/1 cotton count, 3.5 "S" wpi yarn containing no binder material.

Comparative Example 4

A sliver, comprising 17 dpf, 20 cm (8.0 inches) long, Honeywell International grade T317 nylon-6 staple fibers (melt point range of 215 to 225° C.), is wrapped with a 100 denier, 40 filament, continuous heat activated binder yarn to produce a wrapped 1.50/1 cotton count, 3.5 wpi "S" yarn containing 2.82 wt. % heat activated binder fibers. The heat activated binder fibers are a ternary copolyarnide of the 6/66/12 type having a melting point range of about 170–180° C. under ambient humidity conditions. The wrapper yarn is comprised only of the heat activated binder fibers.

Example 5

A spun staple yarn comprising 17 dpf, 20 cm (8.0 inches) long, Honeywell International grade T317 nylon-6 staple fibers (melt point range of 215 to 225° C.), is wrapped with a 100 denier continuous filament yarn. The continuous filament wrapper yarn consists of 40 denier, 12 filament, nylon-6 having a melt point range of 215 to 225° C. and 60 denier, 24 filament, copolyarnide heat-activated adhesive binder fibers. The heat activated binder fibers are a ternary copolyarnide of the 6/66/12 type having a melting point range of about 170–180° C. under ambient humidity conditions.

This yarn of the invention is a 1.50/1 cotton count untwisted wrapped singles yarn with 3.5 "S" wpi and containing about 1.66 weight percent heat activated binder fiber.

Example 6

A spun staple yarn comprising 17 dpf, 20 cm (8.0 inches) long, Honeywell International grade T317 nylon-6 staple fibers (melt point range of 215 to 225° C.), is wrapped with a 70 denier continuous filament yarn. The continuous filament wrapper yarn consists of 40 denier, 12 filament, nylon-6 having a melt point range of 215 to 225° C. and 30 denier, 12 filament copolyarnide heat-activated adhesive binder fibers. The heat activated binder fibers are a ternary copolyarnide of the 6/66/12 type having a melting point range of about 170–180° C. under ambient humidity conditions.

This yarn of the invention is an untwisted wrapped singles yarn of 1.50/1 cotton count yarn with 3.5 "S" wpi and containing about 0.8 weight percent heat activated binder fiber.

Example 7

A spun staple yarn comprising 17 dpf, 20 cm (8.0 inches) long, Honeywell International grade T316 nylon-6 staple fibers (melt point range of 215 to 225° C.) containing 0.06 wt.% of heat activated copolyarnide binder fibers (melt point range of 105 to 180° C.) is wrapped with a 70 denier continuous filament yarn. The continuous filament wrapper yarn consists of 40 denier, 12 filament, nylon-6 having a melt point range of 215 to 225° C. and 30 denier, 12 filament copolyarnide heat-activated adhesive binder fibers. The heat activated binder fibers are a ternary copolyarnide of the 6/66/12 type having a melting point range of about 170–180° C. under ambient humidity conditions.

This untwisted wrapped singles yarn of the invention is a 1.50/1 cotton count yarn with 3.5 "S" wpi and containing about 1.4 weight percent heat activated binder fiber.

Comparative Example 8

A core strand of Honeywell International 1188 denier 70 filament nylon-6 bulked continuous filament (BCF) yarn (melt point range of 215 to 225° C.) is wrapped with a conventional 40 denier, 12 filament, nylon-6 (melt point range of 215 to 225° C.) continuous filament yarn to produce a wrapped yarn with a total denier of 1228, 4.0 "S" wpi, containing no binder material.

Example 9

A core strand of Honeywell International 1188 denier 70 filament nylon-6 bulked continuous filament (BCF) yarn (melt point range of 215 to 225° C.) is wrapped with a 70 denier continuous filaments yarn consisting of 40 denier, 12 filament, nylon-6 (melt point range of 215 to 225° C.) and 30 denier 12 filament heat-activated adhesive binder fibers. The heat activated binder fibers are a ternary copolyarnide of the 6/66/12 type having a melting point range of about 170–180° C. under ambient humidity conditions.

This produces a untwisted wrapped yarn of 1258 denier, 4.0 "S" wpi, containing about 2.4 weight percent heat activated binder fiber.

Example 10

A core strand of Honeywell International 1188 denier 70 filament nylon-6 bulked continuous filament (BCF) yarn (melt point range of 215 to 225° C.) is wrapped with a 60 denier bi-component composite yarn. The bi-component fibers consist of about 50 wt. % of nylon-6 of melting point range of 215 to 225° C. and 50 wt. % of a heat activated ternary copolyarnide binder material of the 6/66/12 type having a melt point range of 170–180° C. in a side-by-side relationship. The 1248 denier wrapped yarn having 4.0 "S" wpi contains about 2.4 weight percent of heat activated binder material.

Carpet Construction and Properties

In each of the above Examples and Comparative Examples 1–10, the yarn is heat set by a conventional Suessen heat setting process. The yarn is passed through a heated chamber at 195° C., while in a relaxed condition with a residence time of 60 seconds.

Each of the heat set yarns are inserted into backing material, cut to form vertical tufts and sheared to produce 1/8 gauge, 11/16 inch pile height, 40 ounce per square yard cut pile carpets. The greige cut pile carpets are then conventionally dyed and finished to obtain the carpet products. The carpets are examined for pile tuft definition, tip retention, hand, wear resistance and carpet appearance relative to a carpet made from a conventional 2 ply twisted yarn as in Comparative Example 1. The evaluation results are presented in Table I.

TABLE I

| Example or Comparative Example No. | Yarn Construction | Wt. % Binder Material | Tuft Definition | Tip Retention | Hand | Wear Resistance |
|---|---|---|---|---|---|---|
| 1 (Comparative) | 3.0/2 CC(1) 4.8 "Z" tpi × 4.1 tpi "S" | 0 | Very Good (control) | Very Good (control) | Firm, Resilient (control) | Good (control) |
| 2 (Comparative) | 3.0/2 CC 4.8 wpi "Z" × 4.1 tpi "S" | 0 | Very Good | Very Good | Firm, Resilient | Good |
| 3 (Comparative) | 1.5/1 CC 3.5 wpi "S" | 0 | Very Poor | Very Poor | Soft, Felt-like | Very Poor |
| 4 (Comparative) | 1.5/1 CC 3.5 wpi "S"(2) | 2.82 | Very Poor | Very Poor | Soft, Felt-like | Very Poor |
| 5 | 1.5/1 CC 3.5 wpi "S" | 1.66 | Very Good | Very Good | Firm, Resilient | Very Good |
| 6 | 1.5/1 CC 3.5 wpi "S" | 0.8 | Good | Good | Firm, Resilient | Good |
| 7 | 1.5/1 CC 3.5 wpi "S" | 1.4(3) | Very Good | Very Good | Firm, Resilient | Very Good |
| 8 | 1228d | 0 | Very Poor | Very Poor | Soft, Felt- | Very Poor |

TABLE I-continued

| Example or Comparative Example No. | Yarn Construction | Wt. % Binder Material | Tuft Definition | Tip Retention | Hand | Wear Resistance |
|---|---|---|---|---|---|---|
| (Comparative) | 4.0 wpi "S" | | | | like | |
| 9 | 1258d 4.0 wpi "S" | 2.4 | Very Good | Very Good | Firm, Resilient | Very Good |
| 10 | 1248d 4.0 wpi "S" | 2.0(4) | Very Good | Very Good | Firm, Resilient | Very Good |

(1)Cotton Count
(2)Wrapper is 100% binder fiber
(3)0.06 wt. % binder fiber in core strand
(4)Bi-component wrapper yarn It is seen that the carpet of the invention of Example 5 containing the untwisted 1.5/1 cotton count yarn with 1.66 weight percent binder fiber in the wrap yarn displays full pile tufts with individual tip retention, pile density, stiff resilient hand, and a carpet surface appearance comparable to that of the conventional 2 ply twisted yarn of Comparative Example 1. Moreover, the carpet of the invention has better wear resistance. Similar advantages are seen for the other carpets of the invention (Examples 6,7,9 and 10).

The yarn construction of Comparative Example 3 is similar to that of Example 5 in every way, except that it contains no binder fiber. However, the carpet of Comparative Example 3 displays completely opened individual pile tufts with no tip retention, a soft felt-like hand, and a carpet surface appearance lacking individual tuft definition and poor wear resistance.

Similarly, the yarn construction of Comparative Example 4 resembles that of Example 5 except that wrapper yarn consists only of heat activated binder fiber and contains no base synthetic fiber. The synergy necessary between a base synthetic fiber and a heat activated binder fiber is absent. In consequence, the carpet of Comparative Example 4 displays completely opened individual pile tufts with no tip retention, a soft felt-like hand, and a carpet surface appearance lacking individual tuft definition and poor wear resistance. This is typical for prior art wrap spun singles yarn, either twist set or non-twist set.

The yarn construction of Comparative Example 8 is similar to that of Example 9 in every way, except that it contains no binder fiber. However, the carpet of Comparative Example 8 displays completely opened individual pile tufts with no tip retention, a soft felt-like hand, and a carpet surface appearance lacking individual tuft definition and poor wear resistance.

Examples 10–29

Other yarns of the invention are prepared having the constructions described in Table II below. Where the core strand cotton count is listed, the core strand is a sliver. Where the core strand denier is listed, the core strand is an untwisted continuous filament yarn. The wrapper yarn in each of the following examples is an untwisted continuous filament yarn. In each Example, the chemical type of the binder material is the same as the base material of the wrapper yarn. Thus, where the base material is a polyarnide, the binder material is a polyarnide. Where the base material is a polyester, the binder material is a polyester. Where the base material is a polyolefin, the binder material is a polyolefin.

TABLE II

| Example No. | Core Strand CC[1] or Denier | Core Strand Material | Wrapper Yarn Denier | Wrapper Yarn Base Material | Wrapper Yarn Wt % Binder | Wrapper Yarn Wraps/inch |
|---|---|---|---|---|---|---|
| 11 | 1000 d | N66[2] | 40 | N66 | 50 | 5 |
| 12 | 1500 d | N66 | 60 | N66 | 40 | 3.5 |
| 13 | 15 CC | N66 | 80 | N66 | 50 | 3 |
| 14 | 1000 | PET[3] | 50 | PET | 50 | 4.5 |
| 15 | 2000 | PET | 80 | PET | 50 | 3 |
| 16 | 2 CC | PET | 80 | PET | 50 | 3 |
| 17 | 1100 | TMT[4] | 40 | TMT | 50 | 4 |
| 18 | 2000 | TMT | 70 | TMT | 50 | 3 |
| 19 | 1.5 CC | Cotton | 80 | PET | 75 | 4 |
| 20 | 1.5 CC | 50/50 w/w Cotton/PET | 80 | PET | 75 | 4 |
| 21 | 1.5 CC | 50/50 w/w Cotton/N6 | 80 | N6 | 75 | 4 |
| 22 | 2 CC | Wool | 75 | N6 | 70 | 3 |
| 23 | 2 CC | 90/10 w/w Wool/N6[5] | 75 | N6 | 70 | 3 |
| 24 | 1000 d | PP[6] | 40 | PP | 50 | 5 |
| 25 | 1500 d | PP | 60 | PP | 40 | 3.5 |
| 26 | 1.5 CC | PP | 80 | PP | 50 | 3 |
| 27 | 1100 d | 50/50 w/w N6/N66 | 40 | N6 | 50 | 5 |
| 28 | 1100 d | 50/50 w/w PET/TMT | 60 | PET | 40 | 3.5 |
| 29 | 1.5 CC | 80/10/10 Wool/N6/N66 | 80 | N6 | 50 | 3 |

[1]cotton count
[2]nylon 66
[3]polyethylene terephthalate
[4]polytrimethylene terephthalate
[5]nylon 6
[6]polypropylene

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. An untwisted wrapped singles carpet yarn consisting essentially of:

a. a core strand comprising a member selected from the group consisting of a sliver and a bulked continuous filament yarn; and b. a wrapper yarn comprising a member selected from the group consisting of a spun staple yarn and a continuous filament yarn;

wherein said wrapper yarn comprises at least one base synthetic fiber material and a heat activated binder fiber having a melting point at least 20° C. lower than the base synthetic fiber.

2. An untwisted wrapped singles yarn as recited by claim 1, wherein the wrapper yarn is a continuous filament yarn of about 20 to 200 denier.

3. An untwisted wrapped singles yarn as recited by claim 1, wherein the wrapper yarn is a continuous filament yarn of about 40 to 80 denier.

4. An untwisted wrapped singles yarn as recited by claim 1, wherein the wrapper yarn contains about 5 to 95 weight percent of the heat activated binder fiber.

5. An untwisted wrapped singles yarn as recited by claim 1, wherein the wrapper yarn contains about 15 to 85 weight percent of the heat activated binder fiber.

6. An untwisted wrapped singles yarn as recited by claim 1, wherein the wrapper yarn contains about 25 to 75 weight percent of the heat activated binder fiber.

7. An untwisted wrapped singles yarn as recited by claim 1, wherein the wrapper yarn makes about 2 to 10 wraps per inch about the core strand.

8. An untwisted wrapped singles yarn as recited by claim 1, wherein the wrapper yarn makes about 3 to 5 wraps per inch about the core strand.

9. An untwisted wrapped singles yarn as recited by claim 1, wherein the core strand is a sliver of about 0.8 to 6 cotton count.

10. An untwisted wrapped singles yarn as recited by claim 1, wherein the core strand is a sliver of about 1 to 5 cotton count.

11. An untwisted wrapped singles yarn as recited by claim 1, wherein the core strand is a sliver of about 1 to 3 cotton count.

12. An untwisted wrapped singles yarn as recited by claim 1, wherein the core strand is a bulked continuous filament yarn of about 900 to 6000 denier.

13. An untwisted wrapped singles yarn as recited by claim 1, wherein the core strand is a bulked continuous filament yarn of about 1000 to 5300 denier.

14. An untwisted wrapped singles yarn as recited by claim 1, wherein the core strand is a bulked continuous filament yarn of about 1000 to 3000 denier.

15. An untwisted wrapped singles yarn as recited by claim 1, wherein the core strand is comprised of at least one member selected from the group consisting of textile fibers of cotton, wool, polyester, polyolefin, and polyarnide.

16. An untwisted wrapped singles yarn as recited by claim 15, wherein the core strand contains about 0–12 weight percent of a heat activated binder fiber having a melting point at least about 20° lower than the textile fiber constituents.

17. An untwisted wrapped singles yarn as recited by claim 15, wherein the core strand contains about 0 to 6 weight percent of a heat activated binder fiber having a melting point at least about 20° lower than the textile fiber constituents.

18. An untwisted wrapped singles yarn as recited by claim 15, wherein the core strand contains about 0 to 3 weight percent of a heat activated binder fiber having a melting point at least about 20° lower than the textile fiber constituents.

19. An untwisted wrapped singles yarn as recited by claim 15, wherein the core strand contains about 0 to 1 weight percent of a heat activated binder fiber having a melting point at least about 20° lower than the textile fiber constituents.

20. An untwisted wrapped singles yarn as recited by claim 16, wherein the total content of heat activated binder fiber is 0.05–2.5 weight percent of the total yarn.

21. An untwisted wrapped singles carpet yarn consisting essentially of;

a. a core strand comprising a member selected from the group consisting of a sliver and a bulked continuous filament yarn;

b. a wrapper yarn comprising continuous filament composite fibers;

wherein said composite fibers are composed of a base synthetic fiber material selected from the group consisting of polyester, polyolefin, polyamide, and a heat activated binder material having a melting point at least 20° C. lower than the base synthetic fiber material.

22. An untwisted wrapped singles yarn as recited by claim 21, wherein the composite fibers of the wrapper yarn have a sheath-core structure with the heat activated binder material comprising the sheath.

23. An untwisted wrapped singles yarn as recited by claim 21, wherein the base synthetic fiber material and the heat activated binder material have a side-by-side relationship in the composite fibers of the wrapper yarn.

24. An untwisted wrapped singles yarn as recited by claim 21, wherein the core strand is comprised of at least one member selected from the group consisting of textile fibers of cotton, wool, polyester, polyolefin, and polyamide.

25. An untwisted wrapped singles yarn as recited by claim 24, wherein the core strand contains about 0–12 weight percent of a heat activated binder fiber having a melting point at least about 20° lower than the textile fiber constituents.

26. An untwisted wrapped singles yarn as recited by claim 25, wherein the total content of heat activated binder fiber is 0.05–2.5 percent of the total yarn.

* * * * *